US008171994B2

(12) United States Patent
Murray et al.

(10) Patent No.: US 8,171,994 B2
(45) Date of Patent: May 8, 2012

(54) MULTI-POSITION VALVE FOR FRACTURING AND SAND CONTROL AND ASSOCIATED COMPLETION METHODS

(75) Inventors: Douglas J. Murray, Magnolia, TX (US); Robert S. O'Brien, Katy, TX (US); Peter J. Fay, Houston, TX (US); Sean L. Gaudette, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 13/015,323

(22) Filed: Jan. 27, 2011

(65) Prior Publication Data

US 2011/0120726 A1 May 26, 2011

Related U.S. Application Data

(62) Division of application No. 11/840,011, filed on Aug. 16, 2007, now Pat. No. 7,971,646.

(51) Int. Cl.
*E21B 43/16* (2006.01)

(52) U.S. Cl. ..... 166/308.1; 166/177.5

(58) Field of Classification Search ..... 166/308.1, 166/177.5, 205

See application file for complete search history.

(56) References Cited

U.S. PATENT DOCUMENTS

| | | | |
|---|---|---|---|
| 2,775,304 | A | 12/1956 | Zandmer |
| 2,855,049 | A | 10/1958 | Zandmer |
| 3,326,291 | A | 6/1967 | Zandmer |
| 3,347,317 | A | 10/1967 | Zandmer |
| 3,358,770 | A | 12/1967 | Zandmer |
| 3,924,677 | A | 12/1975 | Prenner et al. |
| 4,285,398 | A | 8/1981 | Zandmer et al. |
| 4,506,734 | A | 3/1985 | Nolte |
| 5,379,838 | A | 1/1995 | Wilson |

(Continued)

FOREIGN PATENT DOCUMENTS

WO 2005100743 A1 10/2005

OTHER PUBLICATIONS

Puckett, Robert, et al., "Intelligent Well System with Hydraulic Adjustable Chokes and Permanent Monitoring Improves Conventional ESP Completion for an Operator in Ecuador", SPE 88506, Oct. 2004, 1-10.

(Continued)

*Primary Examiner* — William P Neuder
(74) *Attorney, Agent, or Firm* — Steve Rosenblatt

(57) ABSTRACT

A completion tubular is placed in position adjacent the zone or zones to be fractured and produced. It features preferably sliding sleeve valves that can assume at least two configurations: wide open and open with a screen material juxtaposed in the flow passage. In a preferred embodiment the valve assembly has three positions, adding a fully closed position to the other two mentioned. After run in, the valves can be put in the wide open position in any order desired to fracture. After fracturing, the valves can be closed or selectively be put in filtration position for production from the fractured zones in any desired order. Various ways are described to actuate the valves. The tubular can have telescoping pistons through which the fracturing can take place if the application calls for a cemented tubular. Alternatively, the tubular can be in open hole and simply have openings for passage of fracture fluid and external isolators to allow fracturing in any desired order.

21 Claims, 14 Drawing Sheets

U.S. PATENT DOCUMENTS

| | | | | |
|---|---|---|---|---|
| 5,439,055 | A | 8/1995 | Card et al. | |
| 5,588,487 | A | 12/1996 | Bryant | |
| 5,775,425 | A | 7/1998 | Weaver et al. | |
| 5,829,520 | A | 11/1998 | Johnson | |
| 6,016,870 | A | 1/2000 | Dewprashad et al. | |
| 6,047,772 | A | 4/2000 | Weaver et al. | |
| 6,069,118 | A | 5/2000 | Hinkel et al. | |
| 6,209,643 | B1 | 4/2001 | Nguyen et al. | |
| 6,330,916 | B1 | 12/2001 | Rickards et al. | |
| 6,406,789 | B1 | 6/2002 | McDaniel et al. | |
| 6,435,277 | B1 | 8/2002 | Qu et al. | |
| 6,439,309 | B1 | 8/2002 | Matherly et al. | |
| 6,513,595 | B1 | 2/2003 | Freiheit et al. | |
| 6,540,022 | B2 | 4/2003 | Dusterhoft et al. | |
| 6,543,545 | B1 | 4/2003 | Chatterji et al. | |
| 6,582,819 | B2 | 6/2003 | McDaniel et al. | |
| 6,599,863 | B1 | 7/2003 | Palmer et al. | |
| 6,631,738 | B2 | 10/2003 | Jiang | |
| 6,637,517 | B2 | 10/2003 | Samuel et al. | |
| 6,644,345 | B2 | 11/2003 | Dulin | |
| 6,782,948 | B2 | 8/2004 | Echols et al. | |
| 6,938,693 | B2 | 9/2005 | Boney et al. | |
| 6,948,561 | B2 | 9/2005 | Myron | |
| 7,152,678 | B2 | 12/2006 | Turner et al. | |
| 7,387,165 | B2 * | 6/2008 | Lopez de Cardenas et al. | 166/313 |
| 7,604,055 | B2 | 10/2009 | Richard et al. | |
| 2003/0019627 | A1 | 1/2003 | Qu et al. | |
| 2003/0062160 | A1 | 4/2003 | Boney et al. | |
| 2004/0011566 | A1 | 1/2004 | Lee | |
| 2004/0238173 | A1 * | 12/2004 | Bissonnette et al. | 166/307 |
| 2005/0006095 | A1 | 1/2005 | Justus et al. | |
| 2005/0011648 | A1 | 1/2005 | Nguyen et al. | |
| 2005/0274523 | A1 | 12/2005 | Brannon et al. | |
| 2007/0042913 | A1 | 2/2007 | Hutchins et al. | |
| 2009/0084553 | A1 * | 4/2009 | Rytlewski et al. | 166/305.1 |
| 2009/0139717 | A1 * | 6/2009 | Richard et al. | 166/278 |
| 2009/0159290 | A1 | 6/2009 | Lauderdale | |
| 2011/0024105 | A1 * | 2/2011 | Hammer et al. | 166/113 |
| 2011/0056692 | A1 * | 3/2011 | Lopez De Cardenas et al. | 166/305.1 |

OTHER PUBLICATIONS

Going, W.S., et al., "Intelligent-Well Technology: Are We Ready for Closed-Loop Control", SPE 99834, Apr. 2006, 1-11.

Vachon, G., et al., "Production Optimization in ESP Completions with Intelligent Well Technology by Using Downhole Chokes to Optimizer ESP Performance", SPE 93621, Mar. 2005, 1-8.

Sun, Kai, et al, "Modeling the Downhole Choking's Impacts on Well Flow Performance and Production Fluid Allocations of a Multiple-Zone Intelligent Well System", SPE 113416, Jun. 1-13, 2008.

Cain, L.L., "Unique Well Control Choke: Design Objectives vs. Commercial", SPE 16132, Mar. 1987, 713-725.

* cited by examiner

MULTI-POSITION VALVE FOR FRACTURING AND SAND CONTROL AND ASSOCIATED COMPLETION METHODS

CROSS REFERENCE TO RELATED APPLICATION

This application is a divisional of U.S. patent application Ser. No. 11/840,011 filed Aug. 16, 2007

FIELD OF THE INVENTION

The field of the invention relates to completion techniques involving fracturing and more particularly the ability to fracture discrete segments of a formation in a desired order through valved ports which can then be configured for sand control duty to let production begin without using a crossover tool and a separate run for sand control screens after the fracturing operation

BACKGROUND OF THE INVENTION

Typical completion sequences in the past involve running in an assembly of screens with a crossover tool and an isolation packer above the crossover tool. The crossover tool has a squeeze position where it eliminates a return path to allow fluid pumped down a work string and through the packer to cross over to the annulus outside the screen sections and into the formation through, for example, a cemented and perforated casing. Alternatively, the casing could have telescoping members that are extendable into the formation and the tubular from which they extend could be cemented or not cemented. The fracture fluid, in any event, would go into the annular space outside the screens and get squeezed into the formation that is isolated by the packer above the crossover tool and another downhole packer or the bottom of the hole. When a particular portion of a zone was fractured in this manner the crossover tool would be repositioned to allow a return path, usually through the annular space above the isolation packer and outside the work string so that a gravel packing operation could then begin. In the gravel packing operation, the gravel exits the crossover tool to the annular space outside the screens. Carrier fluid goes through the screens and back into the crossover tool to get through the packer above and into the annular space outside the work string and back to the surface.

This entire procedure is repeated if another zone in the well needs to be fractured and gravel packed before it can be produced. Once a given zone was gravel packed, the production string is tagged into the packer and the zone is produced.

There are many issues with this technique and foremost among them is the rig time for running in the hole and conducting the discrete operations. Other issues relate to the erosive qualities of the gravel slurry during deposition of gravel in the gravel packing procedure. Portions of the crossover tool could wear away during the fracking operation or the subsequent gravel packing operation. If more than a single zone needs to be fractured and gravel packed, it means additional trips in the hole with more screens coupled to a crossover tool and an isolation packer and a repeating of the process. The order of operations using this technique was generally limited to working the hole from the bottom up.

What the present invention addresses are ways to optimize the operation to reduce rig time and enhance the choices available for the sequence of locations where fracturing can occur. Furthermore, through a unique multi-position valve system, fracturing can occur in a plurality of zones in any desired order followed by reconfiguring the valve system to place filter media in position so that production could commence with a production string without having to run screens or a crossover tool into the well. These and other advantages of the present invention will be more readily apparent to those skilled in the art from the description of the various embodiments that are discussed below along with their associated drawings, while recognizing that the claims define the full scope of the invention.

SUMMARY OF THE INVENTION

A completion tubular is placed in position adjacent the zone or zones to be fractured and produced. It features preferably sliding sleeve valves that can assume at least two configurations: wide open and open with a screen material juxtaposed in the flow passage. In a preferred embodiment the valve assembly has three positions, adding a fully closed position to the other two mentioned. After run in, the valves can be put in the wide open position in any order desired to fracture. After fracturing, the valves can be closed or selectively be put in filtration position for production from the fractured zones in any desired order. Various ways are described to actuate the valves. The tubular can have telescoping pistons through which the fracturing can take place if the application calls for a cemented tubular. Alternatively, the tubular can be in open hole and simply have openings for passage of fracture fluid and external isolators to allow fracturing in any desired order.

DETAILED DESCRIPTION OF THE PREFERRED EMBODIMENT

Figure 1:
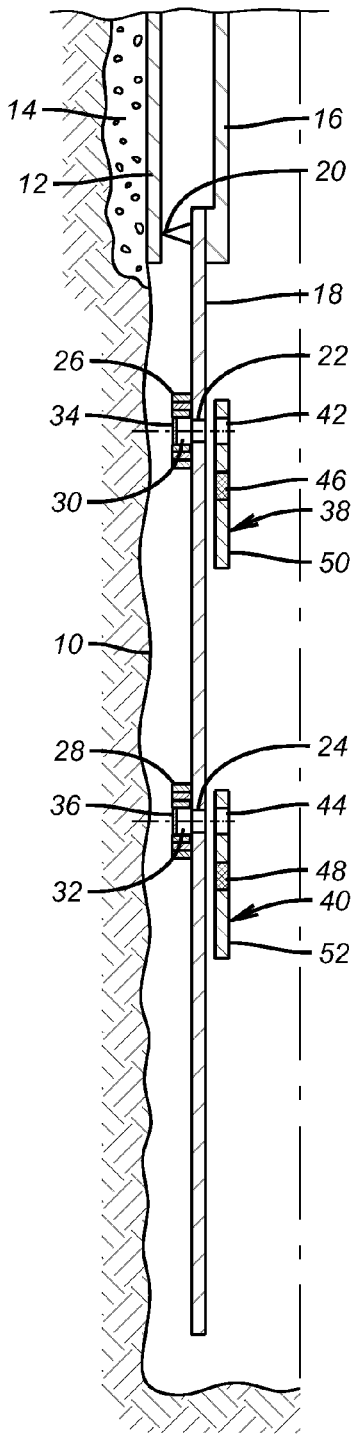
FIG. 1 is a half section view showing three position valves in the open position for run in with the optional telescoping passages retracted.

One way to illustrate the method of the present invention is to refer to FIG. 1. Wellbore 10 has a casing 12 that is cemented 14. A work string 16 suspends a tubular string 18 that has an external liner hanger/seal 20, shown in a set position to support string 18 from casing 12. Illustratively, string 18 is shown with upper ports 22 and lower ports 24. While only a single port 22 or 24 is shown, those skilled in the art will understand that the drawing is schematic and each hole represents multiple openings arranged in any order desired to meet the flow requirements. In this embodiment of the method, each opening 22 and 24 has a telescoping assembly 26 and 28 respectively that are shown in a retracted position for run in. Assemblies 26 and 28 could also be within string 18 for run in. Assemblies 26 and 28 respectively have passages 30 and 32 which are initially respectively blocked by rupture discs 34 and 36. Openings 22 and 24 respectively have a valve assembly 38 and 40 located nearby in tubular 18. In the variation shown in FIG. 1, valve assemblies have a clear port 42 and 44 and a filtration port 46 and 48. They also have a long blank section 50 and 52. The way valve assemblies 38 and 40 operate will be explored in detail later. At this point, referring to assembly 38 but covering however many assemblies like it are used, those skilled in the art can see that there will be a corresponding number of ports 42 or 46 for each port 22. The filtration material in port 46 is preferably a sintered metal but other filtration materials can be used such as mesh screens. The assembly 38 is shown as a three position valve but it can be also be a two position valve that only presents either opening 42 or 46 aligned with port 22. In that configuration, there is no closing the valve assembly 38.

Figure 2:
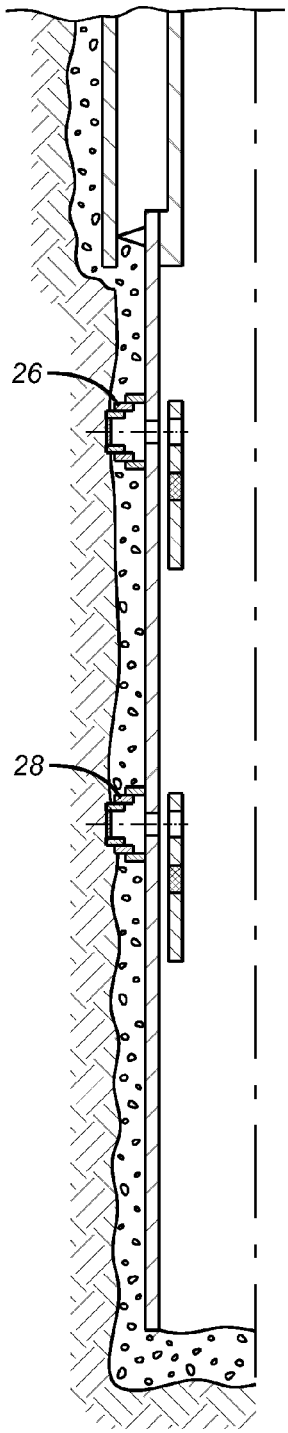
FIG. 2 is the view of FIG. 1 with the tubular cemented and the telescoping passages extended but still blocked off.

FIG. 2 shows the assemblies 26 and 28 extended and the tubular 18 cemented with cement 54. These two steps can be in either order. Nothing else has changed.

Figure 3:
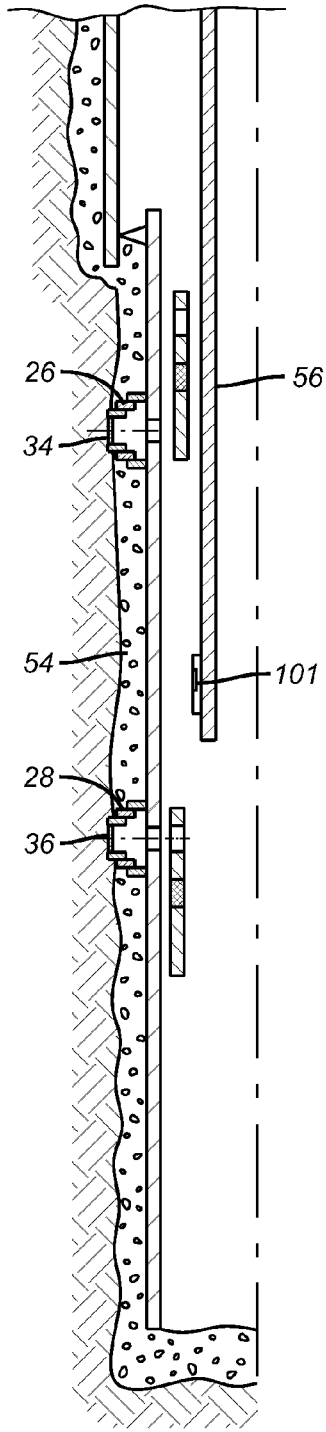
FIG. 3 is the view of FIG. 2 with the upper valve closed and the lower valve open with the passage through the lower telescoping passage open and ready for fracturing.

FIG. 3 shows a work string 56 lowered into position and ready to break rupture disc 36 to fracture through assembly 28.

Figure 4:
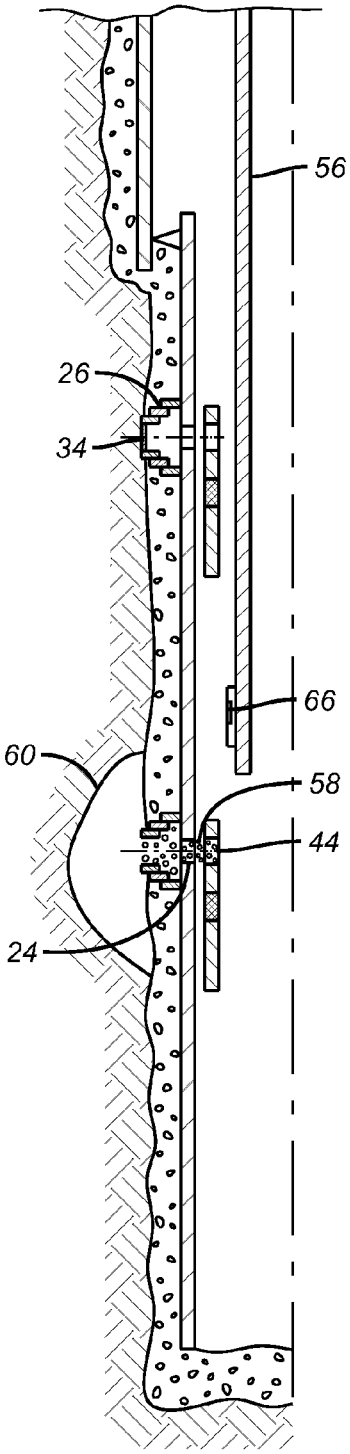
FIG. 4 is the view of FIG. 3 with the fracturing completed through the lower telescoping passage and the upper valve opened for fracturing through the upper telescoping passage.

In FIG. 4 the rupture disc 36 is broken and proppant slurry 58 is pumped under pressure into the formation 60 through assembly 28 via aligned ports 44 and 24. Pressure is maintained until flow drops off indicating the fracture through assemblies 28 is complete.

Figure 5:
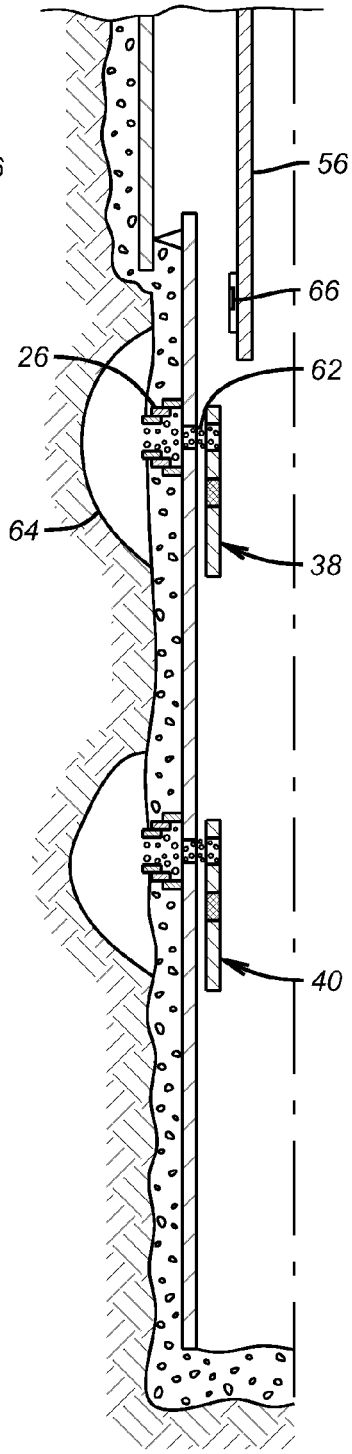
FIG. 5 is the view of FIG. 4 with fracturing complete through the upper telescoping passage.

In FIG. 5 the work string 56 is raised up in preparation for fracturing through assemblies 26 by breaking rupture disc 34 and delivering proppant or sand slurry 62 into formation 64. Prior to delivering proppant or sand slurry 62 the use of a fluid loss control device such as a fluid loss control pill or another mechanism common to the art may be employed.

Figure 6:
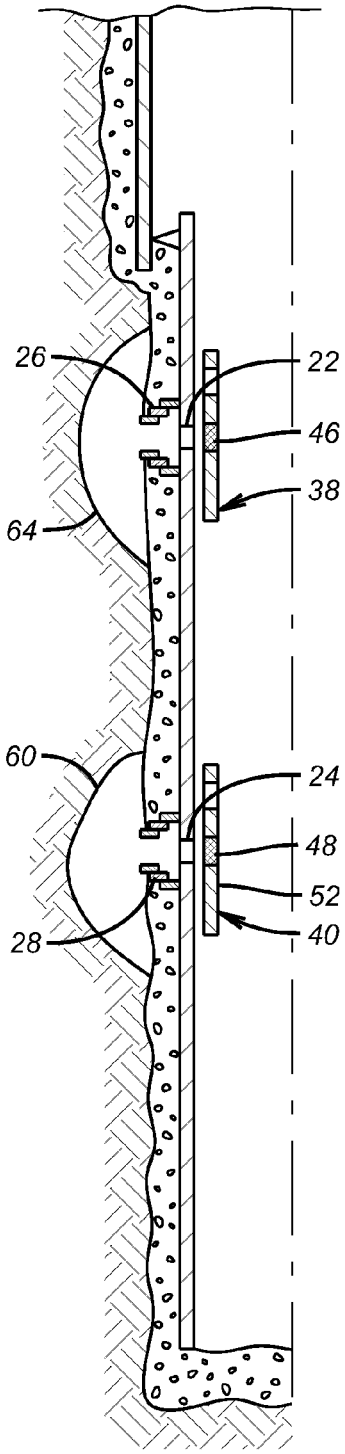
FIG. 6 is the view of FIG. 5 with both valves put in screening position.

It should be noted that the projection 66 on work string 56 is intended to be a schematic representation of one of many ways to shift the valve assemblies 38 and 40 the details of at least some shifting alternatives will be described in more detail below. FIG. 6 illustrates the valve assemblies 38 and 40 shifted up to align respectively port 46 with 22 and port 48 with 24. At this point, a production string can be inserted and the formations 60 or/and 64 can be produced in any desired order or two or more formations at once. Those skilled in the art can appreciate that there can be additional arrays of ports beyond 22 and 24 and they can be aligned with a single producing zone or multiple zones. If there are multiple zones such as 60 and 64 they can be fractured in any desired order or together. Once a zone is fractured through a given array of ports such as 24, those ports can be selectively isolated by juxtaposing blank portion 52 by port 24 for example.

Figure 23:
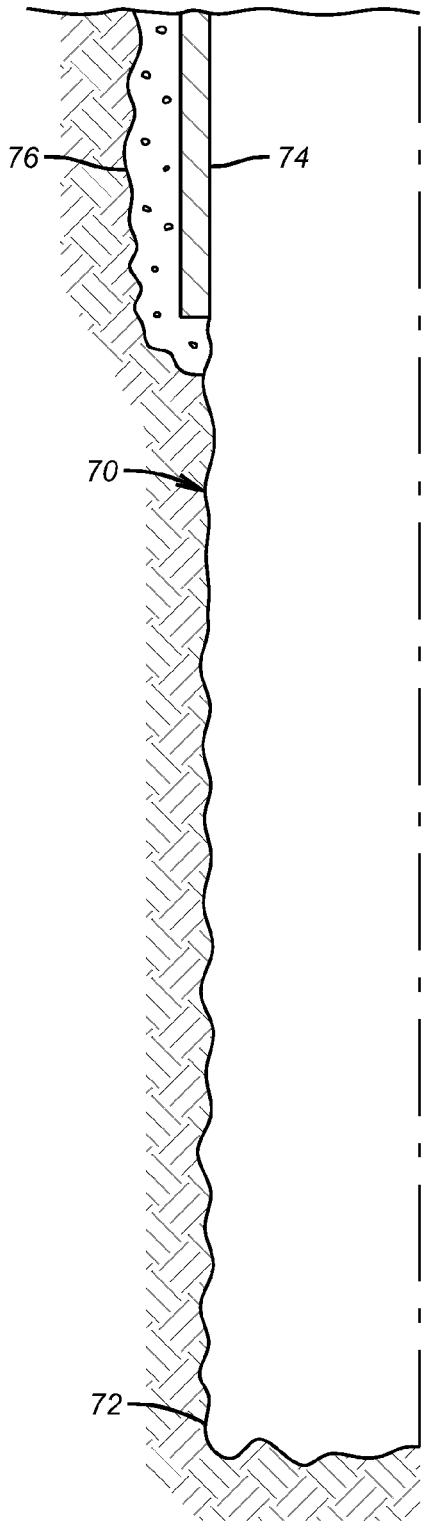
FIG. 23 shows an open hole before insertion of the tubular for a completion.
Figure 24:
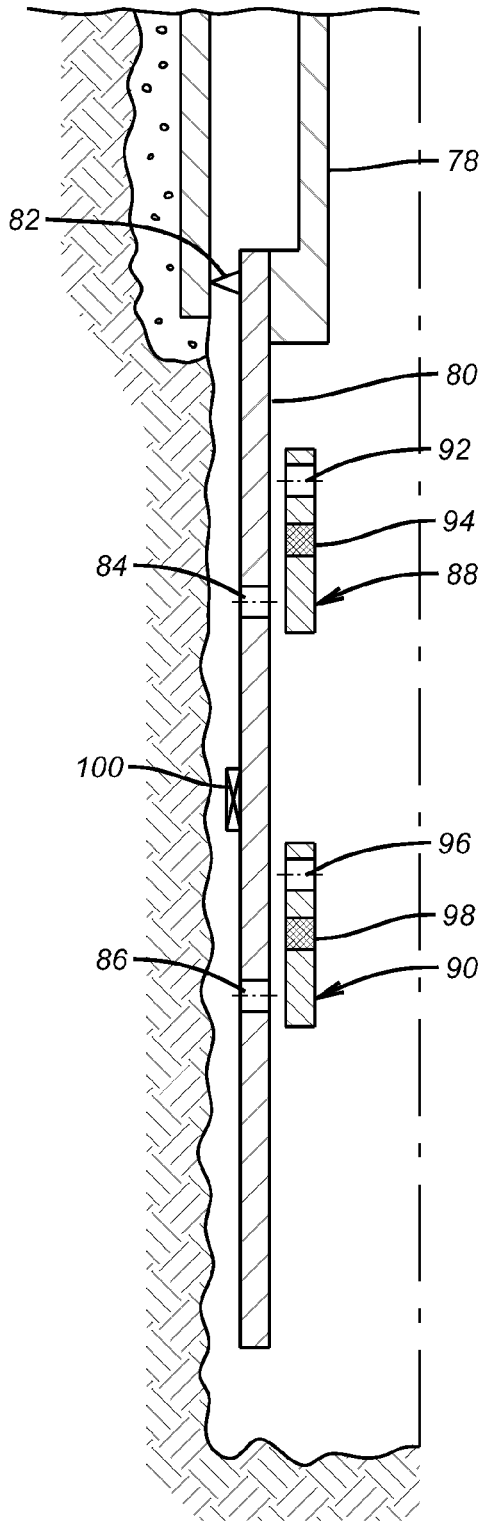
FIG. 24 is the view of FIG. 23 with the completion assembly supported from cemented casing and the multi-position valves closed.

It should also be noted that the use of assemblies 26 and 28 is optional and an open hole method will now be described by first referring to FIG. 23. FIG. 23 shows a wellbore 70 that is an open hole at its lower end 72. Casing 74 is cemented with cement 76. In FIG. 24 a running string 78 carries in a tubular string 80 until it can be secured to casing 74 with a hanger/packer 82. As before, the string 80 has for example two arrays of ports 84 and 86. Each array represents the needed number of openings properly sized and in any desired pattern. Each array of ports 84 and 86 has an associated valve member 88 and 90 respectively. Preferably each valve member has two hole arrays to match the patterns of ports 84 and 86. In valve member 88 that would be arrays 92 and 94 and in valve member 90 it would be arrays 96 and 98. Arrays 92 and 96 are open ports while arrays 94 and 98 have preferably a sintered metal filtration media but other types of screen materials such as wire mesh could also be used. In the FIG. 24 position there is no array alignment with ports 84 or 86 rendering those ports closed. Optionally there can be no closed position and in that case for a given array of ports such as 84 for example, there will either be alignment with array 92 or 94. In either variations of the method being described the valve assemblies need not all be identical. Some can be two position with no closed position and others can be three position with a closed, fracture and screen positions, as required. The actual operation of valve assemblies 88 or 90 will be discussed below. An external packer 100 is shown in the run in position. It can be one of a variety of packer styles and can be set by swelling or by expansion of string 80 with an adjustable swage, for example that can be run in through the work string 78 past valve assembly 88 to expand string 80 from inside in the region of the external packer 100. Other packer types are also envisioned.

Figure 25:
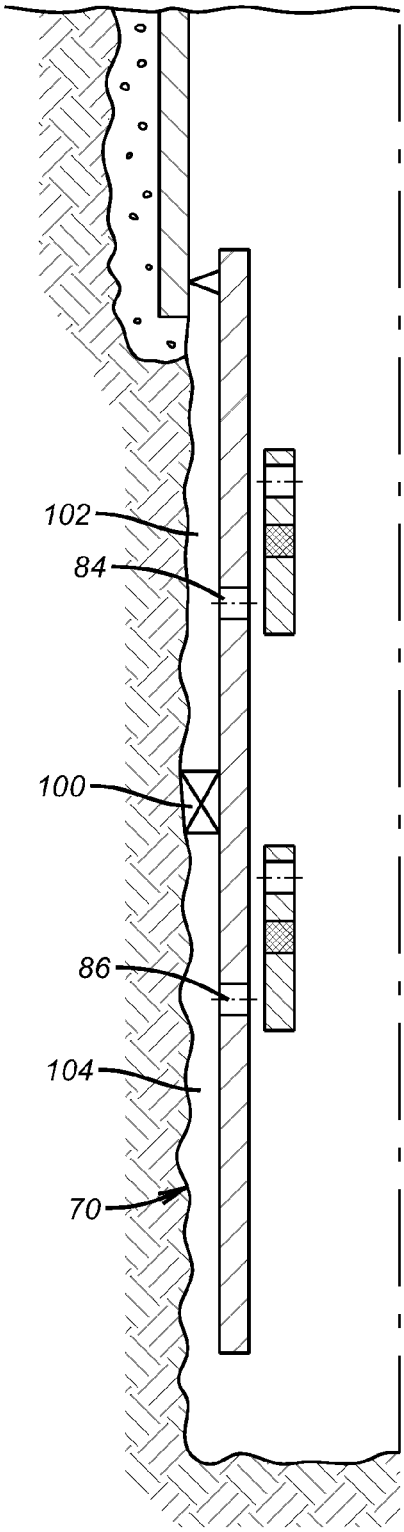
FIG. 25 is the view of FIG. 24 with the external packer set.

In FIG. 25, the packer 100 is set to isolate portion 102 from portion 104 of the wellbore 70. Ports 84 and 86 are both closed.

Figure 26:
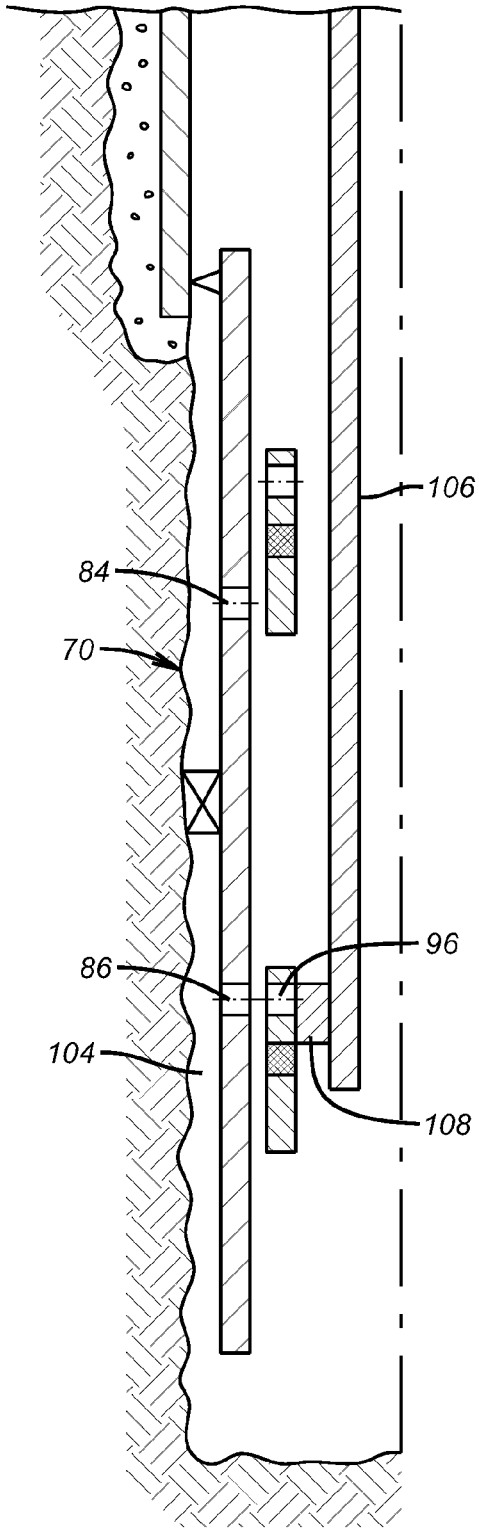
FIG. 26 is the view of FIG. 25 with the lower valve open in a fracturing mode.

In FIG. 26 a work string 106 with a schematically illustrated shifter 108 is run into the wellbore 70 to put the array of openings 96 into alignment with matching array 86 so that segment 104 can be fractured. Openings 84 are still closed.

Figure 27:
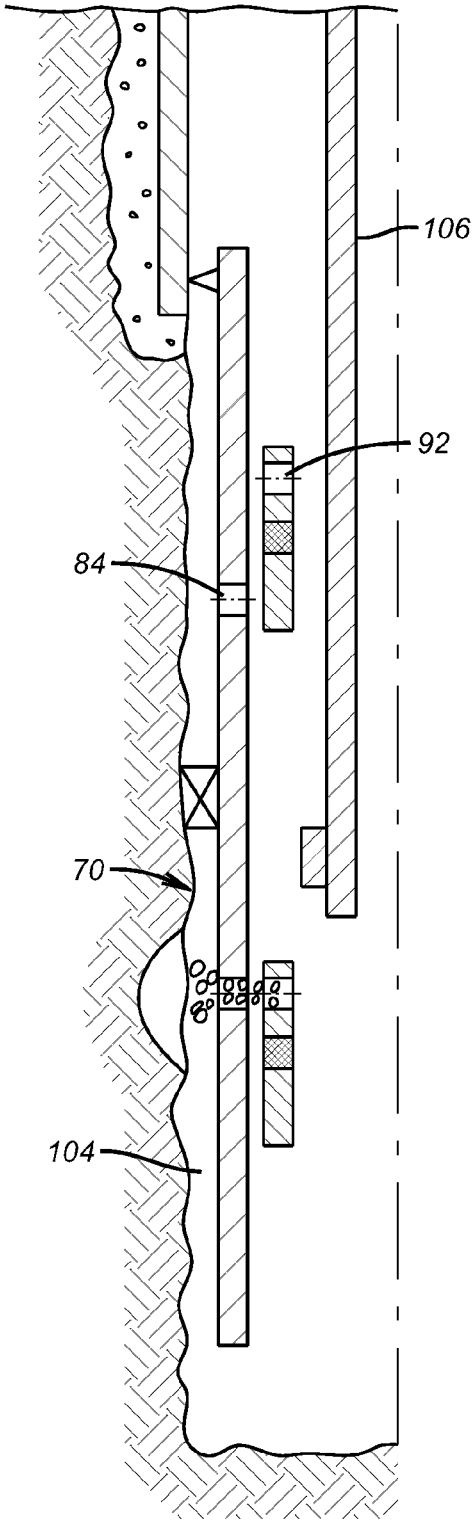
FIG. 27 is the view of FIG. 26 with the string picked up and ready to open the upper valve for fracturing.
Figure 28:
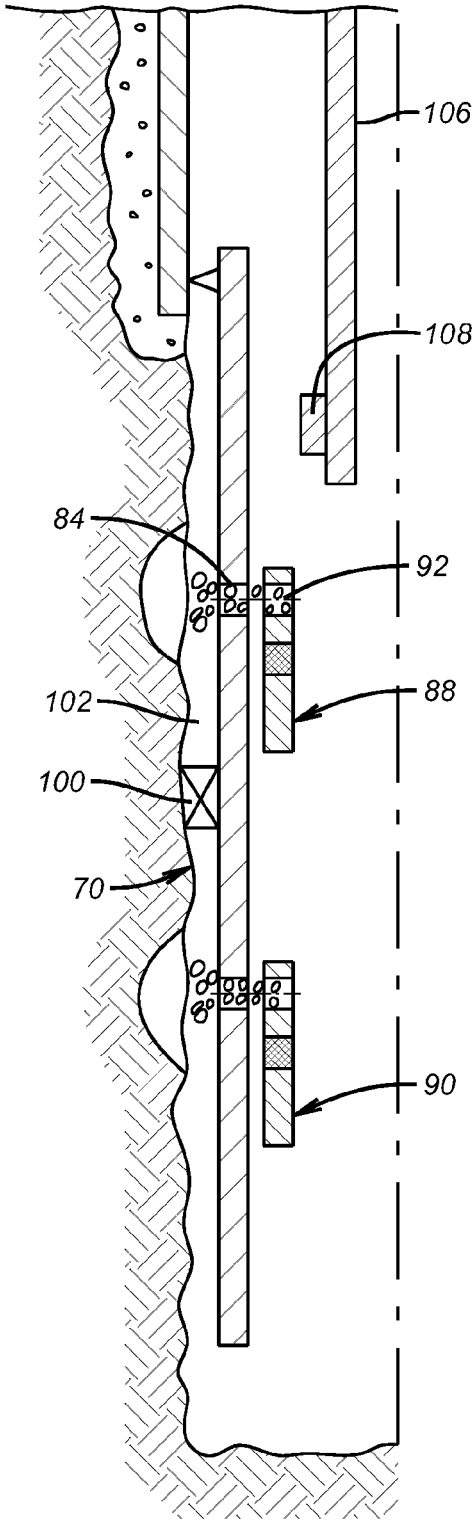
FIG. 28 is the view of FIG. 27 with fracturing complete.

FIG. 27 shows the portion 104 of the wellbore 70 fully fractured and the string 106 repositioned and ready to align array 92 with array 84. In FIG. 28, the frac job for portion 102 of the wellbore 70 uphole of packer 100 has been fractured. The work string 106 has shifted up and is in position to be further manipulated to reposition valve assemblies 88 and 90 into a filtration position.

Figure 29:
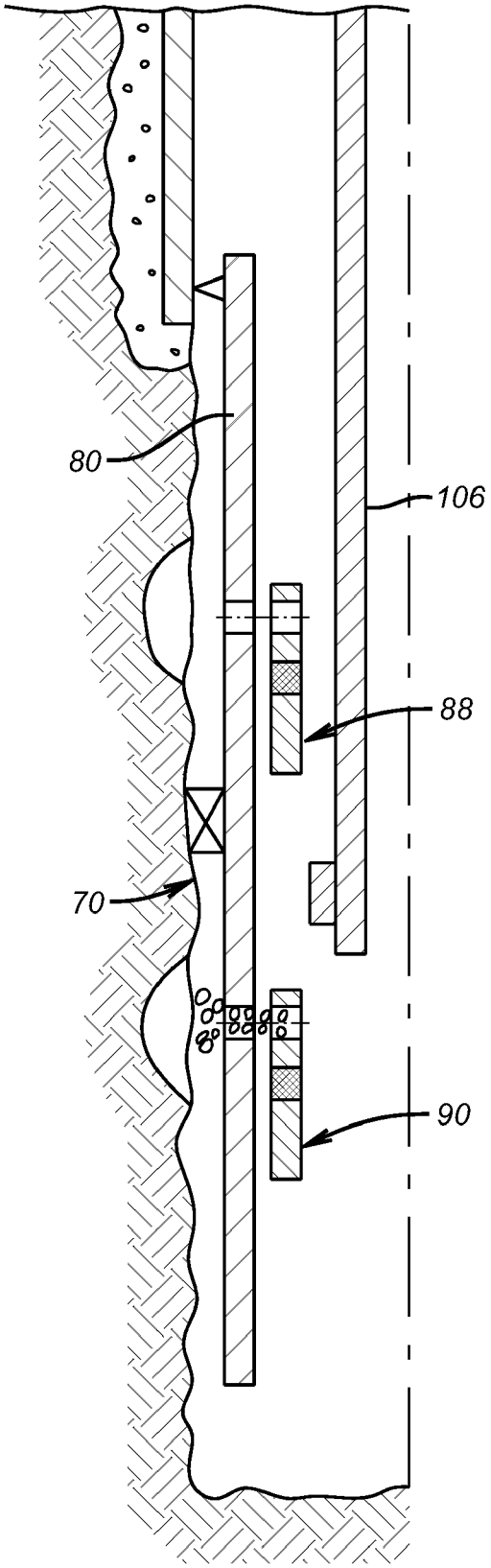
FIG. 29 is the view of FIG. 28 with the string lowered in preparation for putting both valves in filtration mode.
Figure 30:
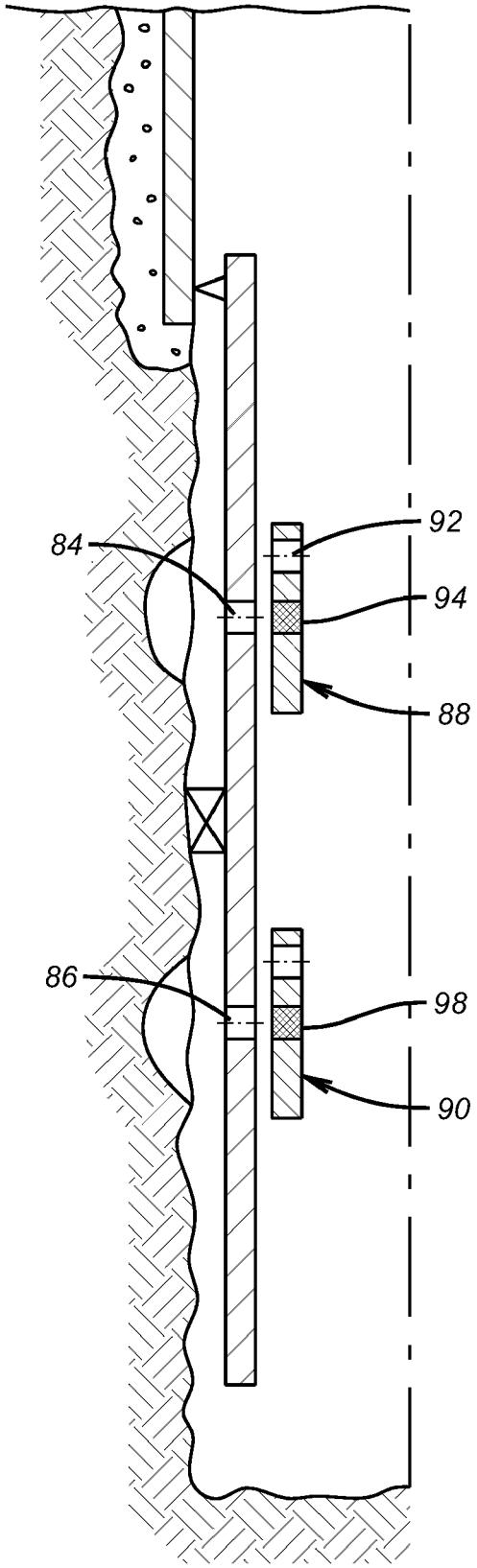
FIG. 30 is the view of FIG. 29 with the string removed and both valves shifted to filtration mode.

FIG. 29 shows the work string repositioned prior to movement of valve assemblies 88 and 90. In FIG. 30 the work string 106 is removed and arrays 94 and 98 are respectively aligned with arrays 84 and 86. The wellbore 70 can now go into production when a production string and a packer are set into position in string 80.

To reduce trips in the wellbore 70 the string 78 that delivers the tubing string 80 can also do duty as a shifting device taking away any need to run a separate string 106 with a shifting device 108 on its lower end. Furthermore, the same string that delivers string 80 can also shift valve assemblies 88 and 90 as described and ultimately with a proper external packer (not shown) can also serve as the production string after the valve assemblies 88 and 90 are in the filtration mode shown in FIG. 30.

The advantage of the method shown in FIGS. 24-30 is that screens and a crossover tool need not be run at all. The fracturing job can be done in any sequence desired by moving valves in the right order and setting external packers to isolate ports such as 84 and 86 in the open hole using a packer such as 100 between pairs of hole arrays. From fracturing the well can go right to production through the filter media in the arrays such as 94 and 98 when aligned with respective arrays 84 and 86. Removing the crossover tool reduces risks of its failure from erosion or from getting stuck and not assuming the squeeze and then the circulation positions it must be put into to do fracturing followed by gravel packing. The elimination of the gravel packing also removes risks of bridging during gravel packing or complex structures such as bypass tubes in the annulus to get around sand bridges that form during gravel packing. Countless hours of rig time are saved as well as equipment charges to the well operator.

Even with the method of FIGS. 1-6 which already had the advantage of eliminating the need to perforate by using assemblies 26 and 28, there is an added advantage from the present method in that production can begin after fracturing by a simple repositioning of valves such as 38 and 40 to the filtration position by aligning ports 46 and 48 respectively with ports 22 and 24. There is no need for a separate trip with screens and a crossover tool and the risks involved using such equipment, as described above. Apart from those benefits are the ability to fracture in any desired order and the ability to produce from any one or more of a desired number of downhole locations. If a certain zone starts to produce water, for example, it can be closed off. If such features are not needed the system can be even more simple using two position valves that allow fracturing or filtration with no closure option. Valve assemblies such as 38 and 40 can be arranged for individual operation or for tandem operation, as needed. They can be locally actuated through a work string 56 with a shifting tool 101 or they can be locally powered or powered by applied pressure, pressure differential, locally mounted and powered motors or other ways.

Figure 7:
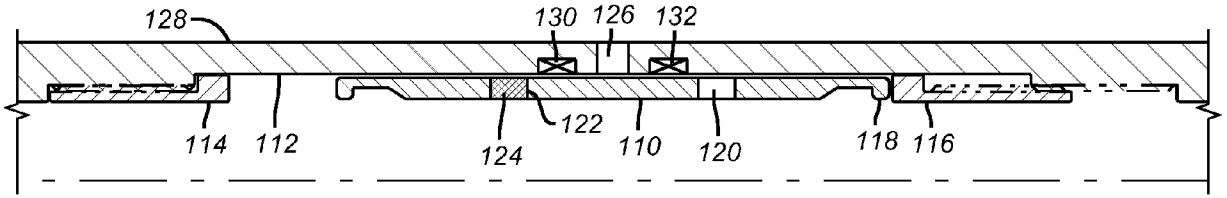
FIG. 7 is a close up view of a three position valve in the closed position.
Figure 8:
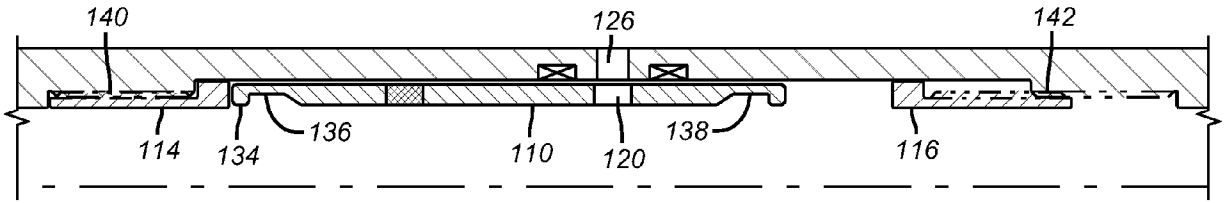
FIG. 8 is the view of FIG. 7 with the valve in the wide open fracturing position.

Different ways to operate the multi-position sliding sleeve valves of the preferred embodiment will now be described. FIG. 7 shows the movable sleeve 110 disposed in a recess 112 whose ends are defined by movable travel stops 114 and 116. Lower end 118 is against stop 116 in FIG. 7 and that puts both ports 120 that is unobstructed and ports 122 that have a filtration media preferably sintered metal 124 out of alignment with ports 126 of the tubular 128. This defines the closed position because a blank wall straddles seals 130 and 132 mounted to the tubular 128. FIG. 8 shows the sleeve 110 shifted so that upper end 134 is against stop 114 to get ports 120 into alignment with ports 126 to define the fracturing position. Those skilled in the art will appreciate that a known shifting tool (not shown) can grab sleeve 110 at grooves 136 or 138 and move sleeve 110 in opposed directions for closing ports 126, as shown in FIG. 7, or putting them in a fully open and unobstructed position for fracturing, as shown in FIG. 8. It should be noted that with the stops 114 and 116 in the FIGS. 7 and 8 positions the ports 122 cannot be put into alignment with ports 126.

Figure 9:
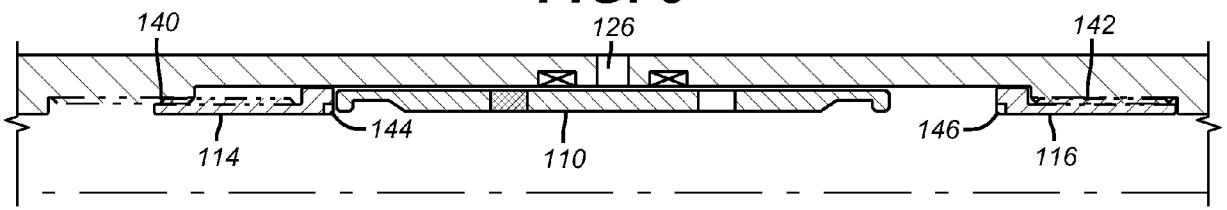
FIG. 9 is the view of FIG. 8 with the travel stops for the sliding sleeve shifted right.
Figure 10:
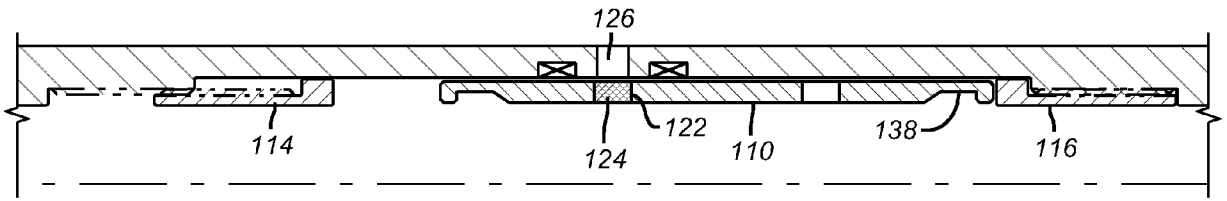
FIG. 10 is the view of FIG. 9 with the sleeve shifted against a relocated travel stop to the filtration position.

Stops 114 and 116 are rotatably mounted using threads 140 and 142 respectively. Stops 114 and 116 have a series of recesses schematically illustrated as 144 and 146 that allow a tool (not shown) to be run in and make contact there to rotate stops 114 and 116 about their respective threads 140 or 142 for repositioning of one or both stops as needed. In FIG. 9 both stops 114 and 116 have been shifted right or downhole. Sleeve 110 has moved in tandem with stop 140 but ports 126 are still closed. FIG. 10 shows sleeve 110 shifted with a tool (not shown) that attached at groove 138. As a result of movement to the right or downhole of sleeve 110 the ports 122 and their filter material 124 are now aligned with ports 126. In the FIG. 10 position for the stops 114 and 116 the only positions possible are ports 126 closed, as in FIG. 9 or ports 126 open for filtration, as in FIG. 10. Those skilled in the art will appreciate that only one stop between 114 and 116 could be moved. While rotating a thread to move the stops longitudinally is illustrated, those skilled in the art will appreciate that the stops can be translated longitudinally and moved by a locally applied mechanical force or a remotely or locally applied pressure force or other techniques that result in longitudinal movement of the stops 114 and 116. Alternatively, stops 114 and 116 could be eliminated and sleeve 110 can be secured in recess 112 by a thread so that rotating it advances it longitudinally or sleeve 110 can be connected by a rack and pinion and driven longitudinally in opposed directions by a locally mounted motor or a driving force provided from a running tool, hydrostatic pressure or applied pressure in the wellbore, to name a few examples. Sleeve 110 can be made in pieces that move relative to each other so that instead of moving the travel stops 114 or 116 one portion of the sleeve 110 can be moved with respect to another to reposition the sleeve or openings thereon to achieve the same choice of positions for ports 126. Yet other modes of manipulation of the sleeve such as 110 will be described below.

Figure 11:
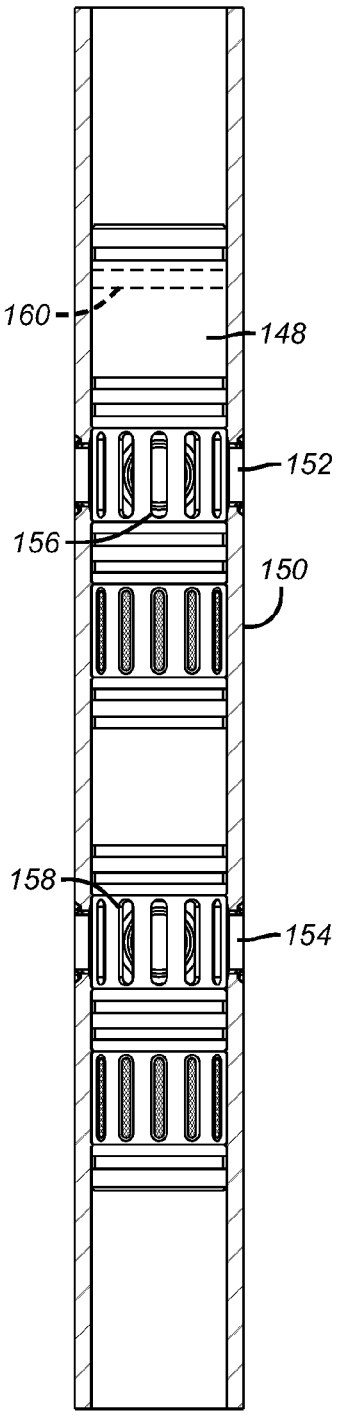
FIG. 11 is a section view of a j-slot guided version of the three position valve in the wide open position for fracturing.
Figure 12:
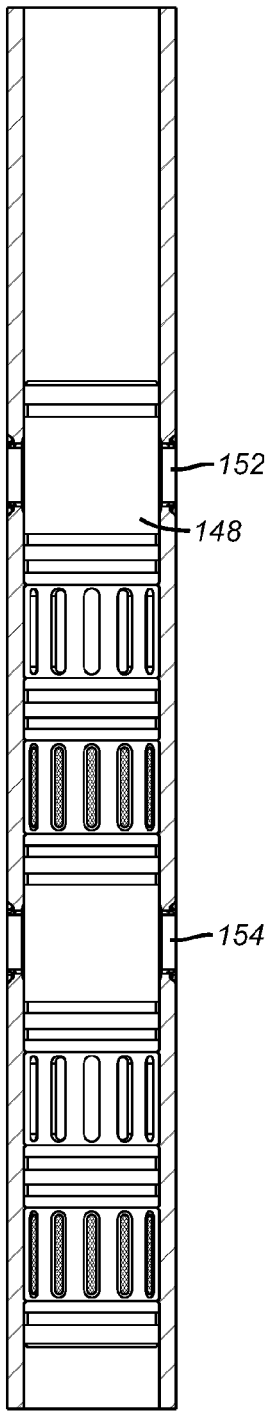
FIG. 12 is the view of FIG. 11 with the valve in the closed position.
Figure 13:
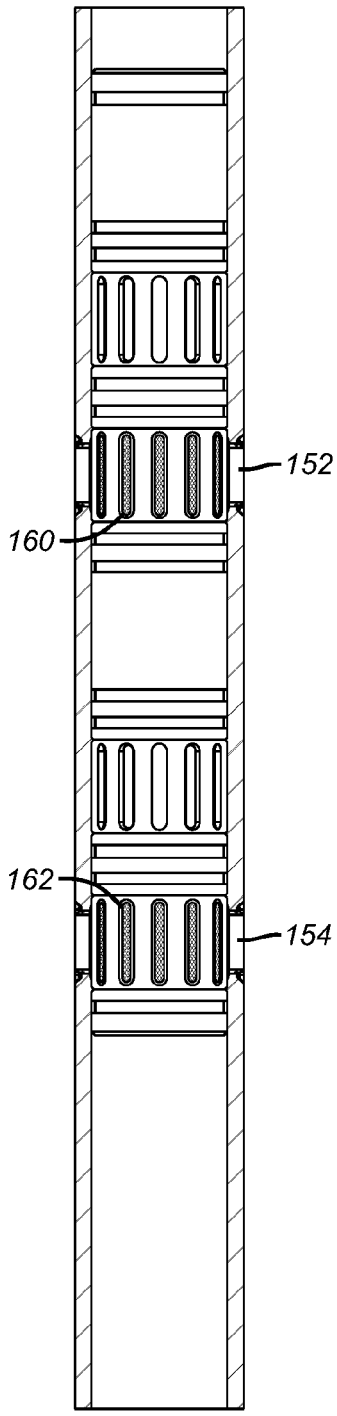
FIG. 13 is the view of FIG. 12 with the valve in the filtration position.
Figure 15:
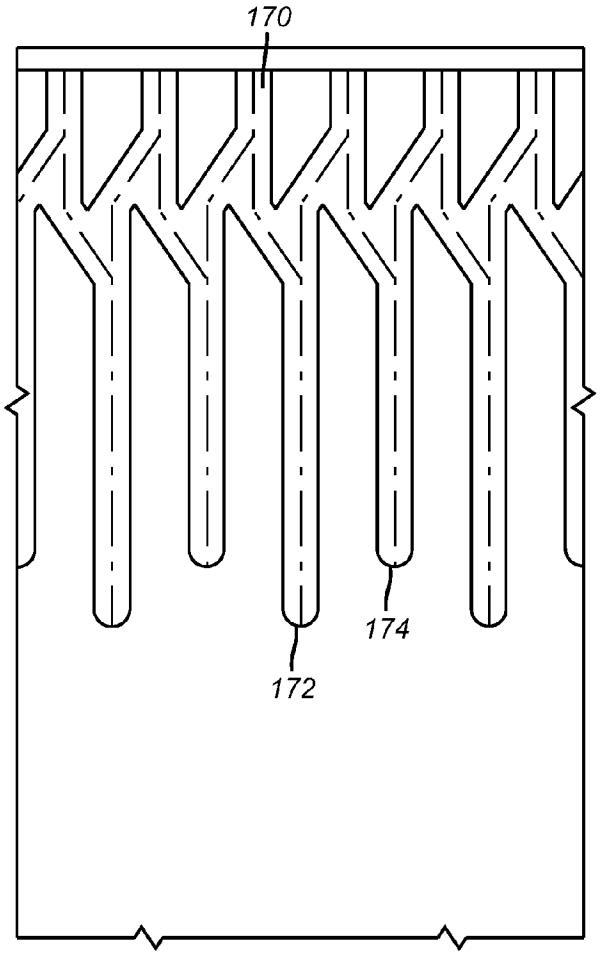
FIG. 15 is an alternative j-slot to the one in FIG. 14 to achieve the three positions shown in FIGS. 11-13.
Figure 14:
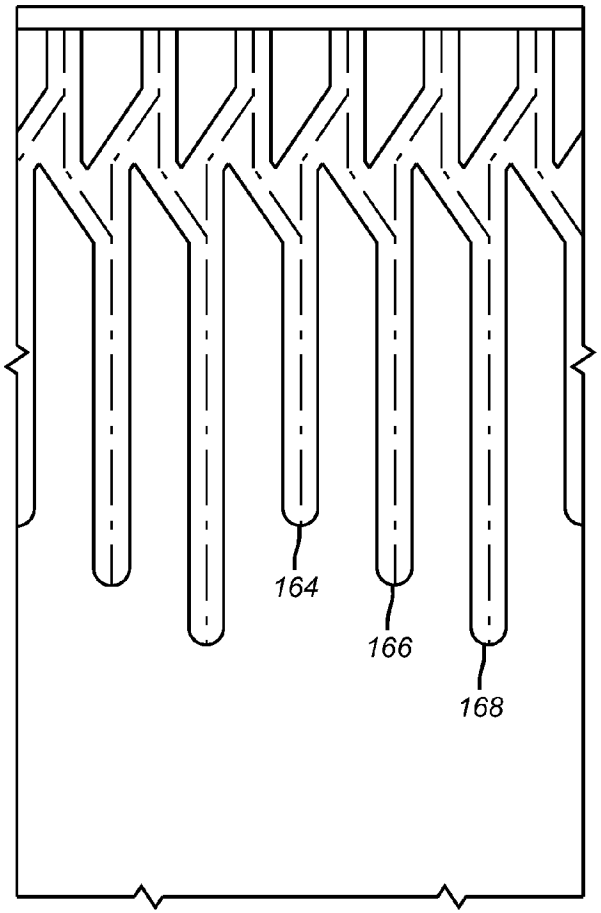
FIG. 14 is one possible j-slot layout to achieve the three positions shown in FIGS. 11-13.

FIG. 11 shows a valve member 148 in a housing 150 that has port arrays 152 and 154 for example. Valve member 148 has unobstructed arrays 156 and 158 shown aligned with ports 152 and 154 to define the fracturing position. In this design the valve member 148 is secured to the housing 150 with a j-slot mechanism, two examples of which are illustrated in FIGS. 14 and 15. One way of manipulating the valve member 148 is to use a shifting tool (not shown) and grab an internal recess 160 so that a pickup or set down force can be applied to sleeve 148 to move it to the FIGS. 12 and 13 positions by taking advantage of the j-slot assembly that movably secures the valve member 148 to the housing 150. FIG. 12 shows the valve member shifted from the FIG. 11 position so that ports 152 and 154 are obstructed by valve member 148 to define the fully closed position. FIG. 13 shows port arrays 160 and 162 that carry a filtering material, preferably sintered metal, and now in alignment with ports 152 and 154 which is the ready for production position that is used after fracturing is complete. Fracturing occurs with the components in the FIG. 11 position. There are thus, three positions for the illustrated valve assembly which need definition in the j-slot mechanism. The j-slot in FIG. 14 operates to change positions of the valve member 148 by a combination of a pick up and a set down of weight. When the pin (not shown) lands at the uppermost point 164 of the rolled open j-slot pattern shown in FIG. 14 the valve member 148 is in the FIG. 13 position for production with screening. In the 166 position, the valve member is in the fracturing position of FIG. 11. Finally, when the j-slot pin lands at position 168 the valve member 148 is in the closed position of FIG. 12. Alternatively, the three positions can be obtained with a j-slot that uses pick up and hold at point 170 of FIG. 15 as the production with filtration position shown in FIG. 13. Position 174 for the j-slot pin corresponds to the fracture position of FIG. 11 and position 172 corresponds to the closed position of FIG. 12.

Although a single sleeve is shown with two spaced arrays where at each location there are unobstructed and filtered ports there could be additional or fewer such arrays on a single valve member 148. The closed position is optional. Movement of the valve member 148 can also be accomplished using pressure techniques as will be described below.

Figure 16:
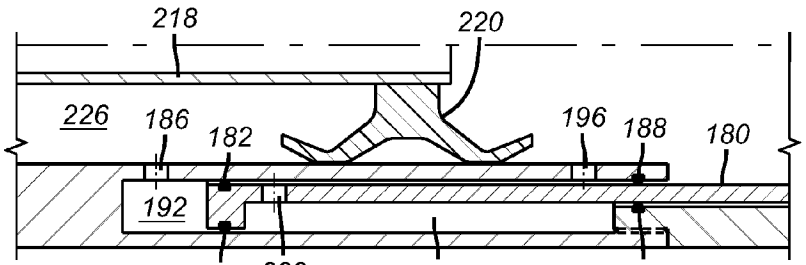
FIG. 16 is a detailed view of a sliding sleeve design that operates on pressure differential between an annulus around a tubing string and pressure inside it.
Figure 17:
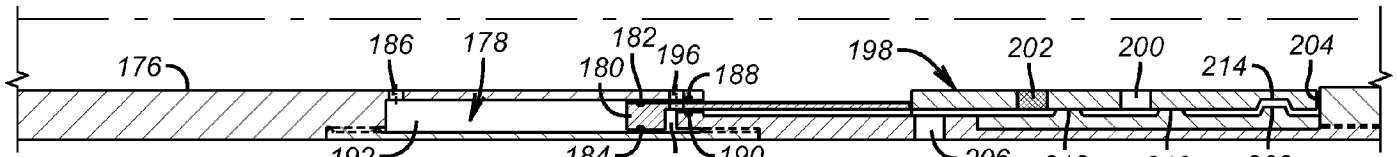
FIG. 17 is the overall view of a three position valve in the closed position showing the indexing device for the three positions.

One such pressure technique is illustrated in FIGS. 16-19. Referring first to FIG. 17 to see the overall assembly, a housing 176 joined by threaded connections has an annular wall recess 178 in which is mounted a movable piston 180 that has seals 182 and 184 and a port 186 that leads into recess 178. Seals 188 and 190 allow the piston to reciprocate while holding pressure in recess 178. Piston 180 divides recess 178 into variable volume cavities 192 and 194. In FIG. 17, port 196 communicates with cavity 194. Piston 180 is connected to valve member 198 that has an array of unobstructed openings 200 and an array of filtered openings 202. A travel stop 204 defines the FIG. 17 position where the array of ports 206 is closed by the valve member 198. Housing 176 also has a series of spaced projections 208, 210 and 212 that are preferably on a predetermined spacing. Valve member 198 has a depression 214 shown in FIG. 17 to be registered with projection 208 to hold the position of FIG. 17 with ports 206 closed.

Figure 18:
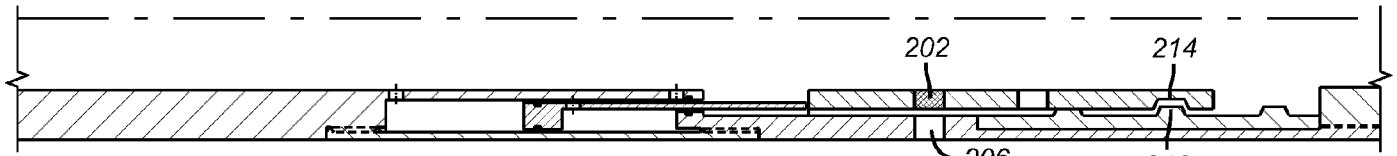
FIG. 18 is the view of FIG. 17 with the valve in the filtration position.
Figure 19:
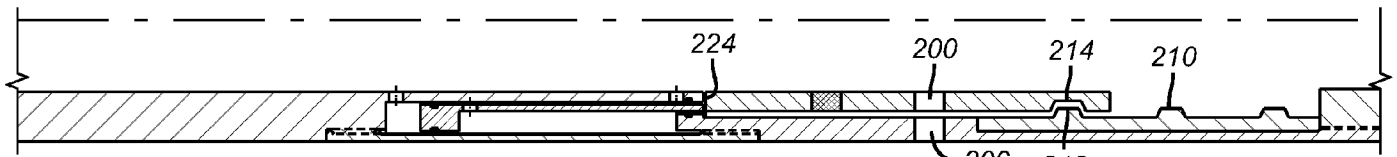
FIG. 19 is the view of FIG. 18 with the valve in the wide open position.

Referring now to FIG. 16 for additional details, a running string 218 has an external seal 220 that is shown positioned between openings 186 and 196. Piston 180 has a port 222 that permits pressure delivered through string 218 to go through port 196 and then through port 222 to reach cavity 194 to push piston 180 to the left or uphole. Movement of piston 180 uphole takes with it valve member 198 as recess 214 jumps over projections 208 and moves uphole until recesses 214 registers with projection 210. This position is shown in FIG. 18 and illustrates the alignment of array of filtration ports 202 with housing ports 206. The registration of projections with depressions is but one way to assure that a predetermined movement of valve member 198 has occurred, in this case responsive to an applied pressure of a predetermined value. A removal of pressure when a spike is sensed simply holds the last obtained position. To get to the position of FIG. 19 where unobstructed ports 200 line up with ports 206 to define the ready to fracture position, the pressure in string 218 while in the FIG. 16 position, is simply raised again until recess 214 jumps over projection 210 and lands on projection 212. At the same time, the valve member also hits travel stop 224. The ready to fracture position of FIG. 19 is now defined. Referring again to FIG. 16, as the piston 180 moves uphole or to the left, displaced fluid from above it exits port 186 and goes into annular space 226 between tubular string 218 and housing 176. The movement of piston 180 can be reversed by simply applying pressure into annular space 226 to push down piston 180 while displacing fluid from cavity 194 through ports 222 and then 196 followed by a return into the string 218.

Figure 20:
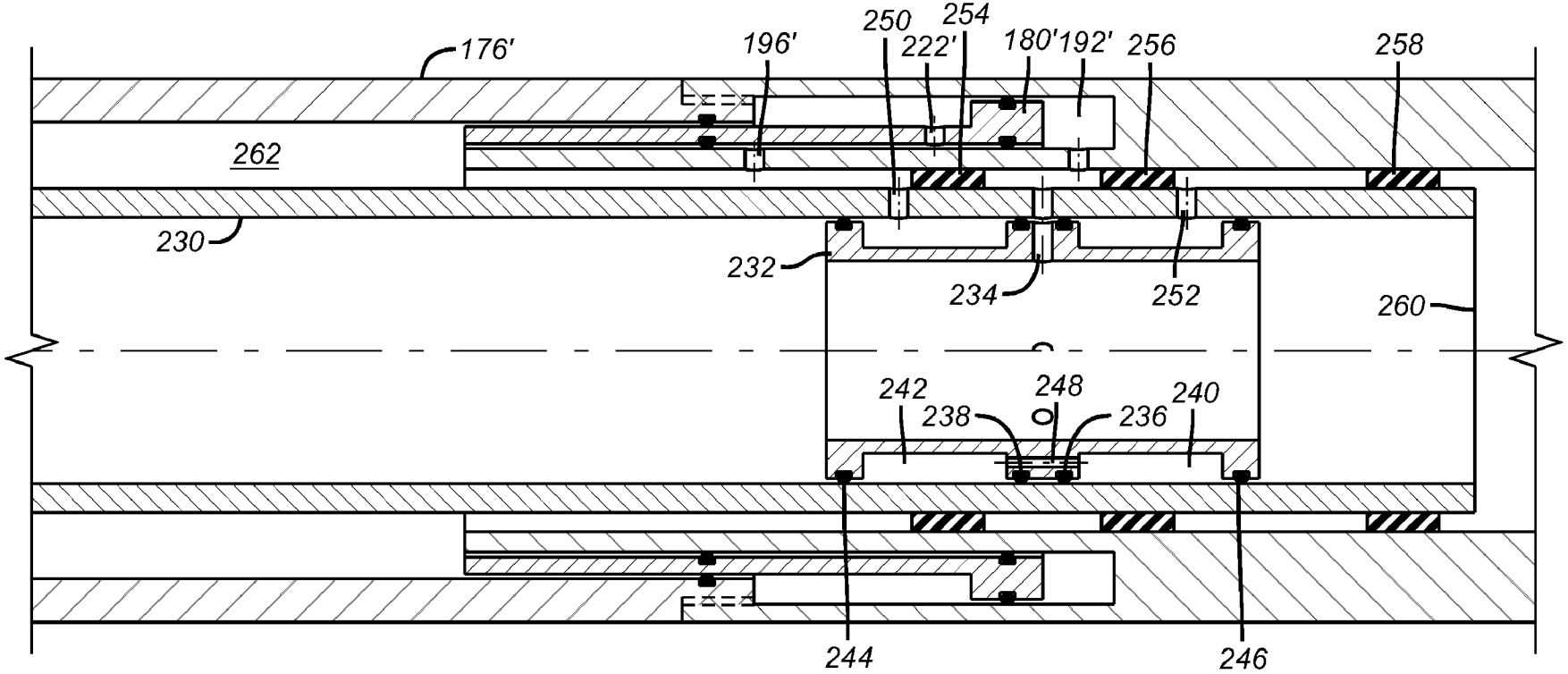
FIG. 20 is an alternative pressure based way of moving the multi-position valve shown in a position for pushing the piston downhole.
Figure 21:
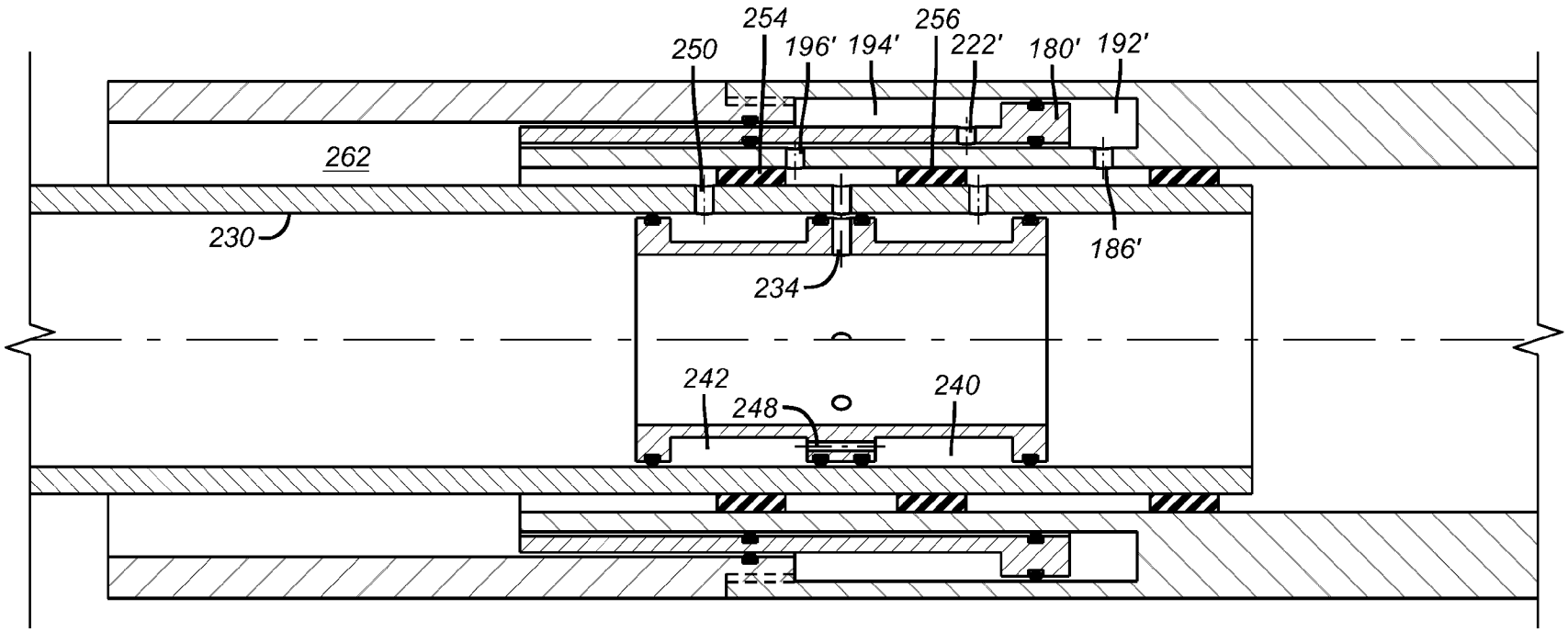
FIG. 21 is the view of FIG. 19 in a position to push the piston uphole.
Figure 22:
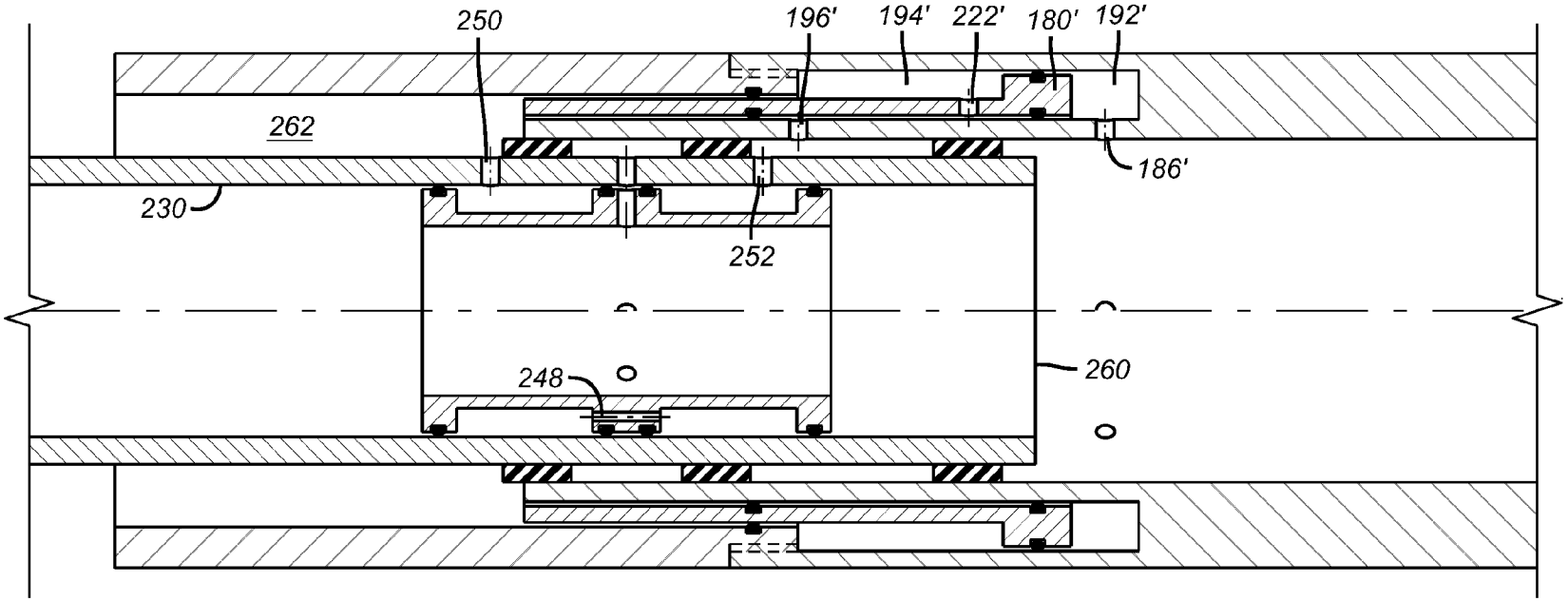
FIG. 22 is the view of FIG. 20 in a neutral position where pressure does not cause movement.

Rather than relying on a pressure differential between the inside of string 218 and the annulus 226 around it as in FIGS. 16-19, an alternative using applied pressure is illustrated in FIGS. 20-22. The parts in the housing 176' are identical to the FIGS. 16-19 embodiment. What is different is that work string 230 has an internal sleeve 232 with a series of radial ports 234 that emerge between seals 236 and 238. Annular cavities 240 and 242 are formed respectively between seal pairs 238 and 244 for cavity 242 and seals 236 and 246 for cavity 240. Passage 248 fluidly connects cavities 240 and 242. Passage 250 exits from cavity 242 through the wall of string 230 and above external seal 254. Passage 252 exits cavity 240 between external seals 256 and 258. Ports 234 provide a radial exit from within string 230 through its wall and between external seals 254 and 256. Assuming string 230 is closed or can be closed at its lower end 260 or the extension of the tubular housing 176' is closed to pressure below lower end 260, applying pressure in the FIG. 20 position directs pressure from ports 234 into cavity 192' to move the piston 180' as the cavity 192' gets bigger while cavity 194' gets smaller by displacing fluid through ports 222' followed by ports 196' followed by annulus 262, which is equalized with cavities 240 and 242. In this manner, the piston 180' can be advanced to its other positions as previously described.

Referring to FIG. 21 for opposite movement of the piston 180', the ports 234 are now in fluid communication with ports 196' instead of 186' as in FIG. 20. Ports 250 are now in communication with the annulus 262. Pressure applied from string 230 through ports 234 communicates to ports 196' and then through ports 222' to push piston 180' in a direction to make cavity 194' larger in volume and cavity 192' smaller in volume. The displaced fluid from cavity 192' goes through ports 186', then into cavity 240, then into cavity 242 through passage 248, then through ports 250 and into annulus 262. The resulting movement of the valve member (not shown in FIGS. 20-22) is the same as described with regard to FIGS. 16-19. FIG. 22 shows another way to get the same result as the position of the string 230 in FIG. 20. In FIG. 22, the pressure is simply delivered out the lower end 260 and goes into ports 186'. From there, the pressure enlarges cavity 192' and displaces fluid from cavity 194' in series through ports 222', 196', 252, passage 248, ports 250 and into annular space 262.

Those skilled in the art will appreciate that the present invention allows for dual purpose ports in a tubular string that can accommodate fracturing and then be switched to filtration so that in an open hole completion, for example, there is no need to run in a screen assembly and a crossover tool. The ports can be configured for fracturing in any order needed and can have external isolators in the open hole between them so as to allow different portions of the wellbore to be treated individually or together as needed and in any desired order. By the same token, different regions can be produced or shut off as needed. The valve assembly can be two positions for fracturing and production or three positions by adding a closed position. Trips to the well can be reduced further by using the same run in string to deliver the completion string, move the valves in it as needed and also serve as the production string after putting the required valves in production mode. Different techniques can be used to actuate the valves including mechanical force, pressure and a j-slot combined with physical manipulation to name a few. The elimination of a crossover tool and a screen section not only saves rig time but eliminates the operational risks that are associated with using crossover tools and gravel packing screens, such as erosion in the crossover tool and bridging in the gravel pack.

Figure 33:
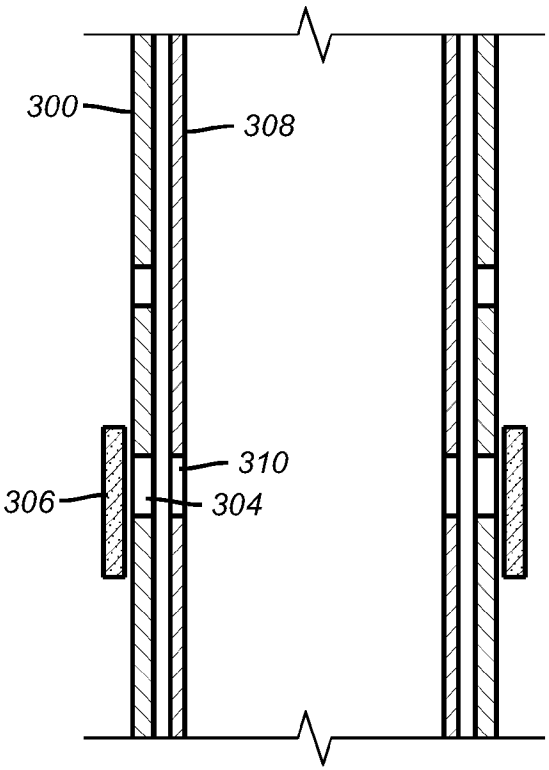
FIG. 33 is the view of FIG. 32 with the filtering ports open.
Figure 32:
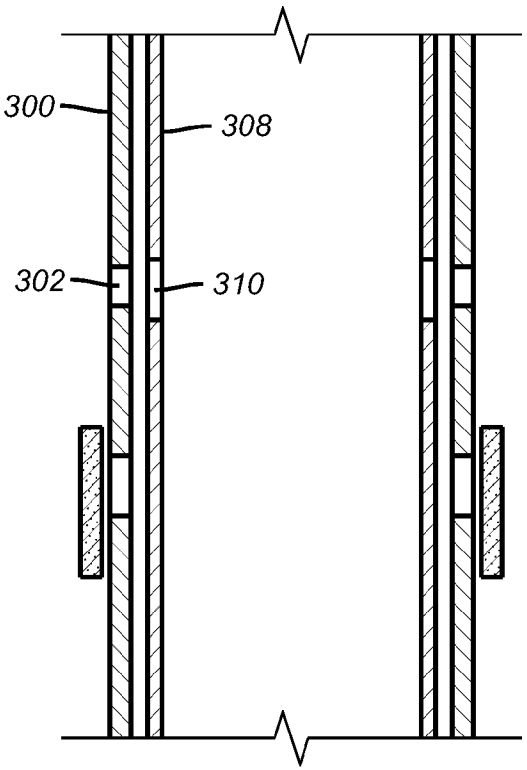
FIG. 32 is the view of FIG. 31 with the fracture ports open.
Figure 31:
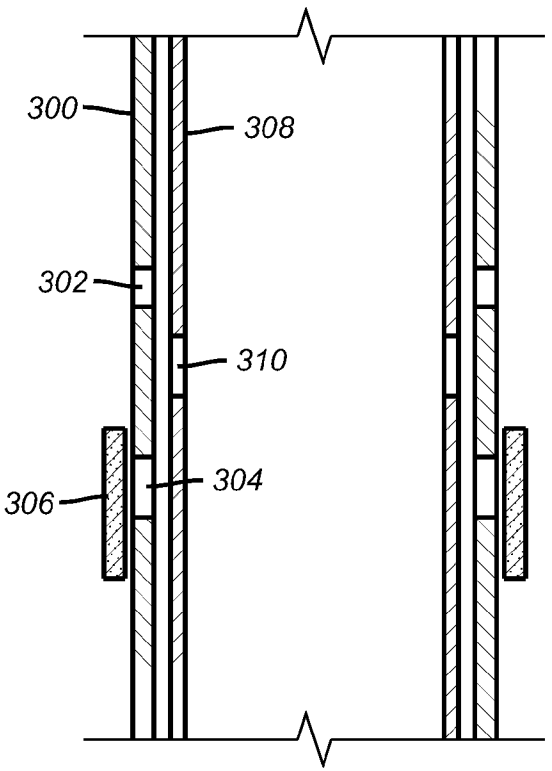
FIG. 31 is a schematic view of an alternative embodiment using discrete ports in the tubular for fracturing and filtering showing the closed ports position.

An alternative embodiment is illustrated in FIGS. 31-33. In FIG. 31 the tubular 300 has a fracturing port array 302 and a filtration port array 304 with a filer media 306 associated with each port 304. A sliding sleeve 308 with an array of ports 310 to selectively match arrays 302 or 304 or neither for the closed position shown in FIG. 31. FIG. 32 shows the fracturing position and FIG. 33 shows the filtration position for production. The present invention incorporates the option of using a common port on the tubular with the filter material on the sliding sleeve or having sets of ports on the tubular with the filter material on one set of tubular ports and the other set wide open for fracturing as illustrated in FIGS. 31-33.

The above description is illustrative of the preferred embodiment and many modifications may be made by those skilled in the art without departing from the invention whose scope is to be determined from the literal and equivalent scope of the claims below.

We claim:

1. A completion method, comprising:
providing at least one wall opening in a tubular string, a multi-position valve associated with said at least one opening, and at least one external barrier on said string;
positioning said string in a wellbore;
isolating a portion of the wellbore with said barrier;
fracturing said isolated portion of the wellbore through said at least one opening when said opening is substantially unobstructed;
positioning said valve to allow flow through a filter and said at least one wall opening after said fracturing
longitudinally shifting said valve between travel stops;
movably mounting at least one travel stop.

2. The method of claim 1, comprising:
providing said multi-position valve in the form of a movable sleeve;
defining a fully open position said wall opening in said tubular string with or without said sleeve overlapping said wall opening;
positioning an opening on said sleeve with a filter media therein in the path of said wall opening.

3. The method of claim 2, comprising:
providing an unobstructed opening on said sleeve;
aligning said unobstructed opening with said wall opening prior to said fracturing.

4. The method of claim 2, comprising:
providing a solid portion on said sleeve;
aligning said solid portion with said wall opening to close it.

5. The method of claim 2, comprising: movably mounting said sleeve to said tubular string with a j-slot mechanism.

6. The method of claim 5, comprising: achieving a plurality of positions of said sleeve with respect to said wall opening using combined pickup and set down force applied to said sleeve.

7. The method of claim 6, comprising: defining at least one position of said sleeve by applying and holding a pickup force.

8. The method of claim 1, comprising:
providing a plurality of said wall ports in at least two axially spaced locations with said at least one external barrier in between defining at least two zones in the wellbore;
operating said multi-position valves so that said fracturing can take place in said zones in a desired order.

9. The method of claim 8, comprising:
using said multi-position valves for said producing from said zones in a desired order after said fracturing.

10. The method of claim 1, comprising:
actuating said barrier toward the wellbore wall during or after placement of said tubular string in the wellbore.

11. A completion method, comprising:
providing at least one wall opening in a tubular string, a multi-position valve associated with said at least one opening, and at least one external barrier on said string;
positioning said string in a wellbore;
isolating a portion of the wellbore with said barrier;
fracturing said isolated portion of the wellbore through said at least one opening when said opening is substantially unobstructed;
positioning said valve to allow flow through a filter and said at least one wall opening after said fracturing;
using a running string to position said tubular string in the wellbore;
supporting said tubular string in the wellbore independently of said running string;
manipulating said multi-position valve with said running string.

12. The method of claim 11, comprising:
performing production through said running string.

13. A completion method, comprising:
providing at least one wall opening in a tubular string, a multi-position valve associated with said at least one opening, and at least one external barrier on said string;
positioning said string in a wellbore;
isolating a portion of the wellbore with said barrier;
fracturing said isolated portion of the wellbore through said at least one opening when said opening is substantially unobstructed;
positioning said valve to allow flow through a filter and said at least one wall opening after said fracturing;
providing said multi-position valve in the form of a movable sleeve;
defining a fully open position said wall opening in said tubular string with or without said sleeve overlapping said wall opening;
positioning an opening on said sleeve with a filter media therein in the path of said wall opening;
longitudinally shifting said sleeve between travel stops;
movably mounting at least one travel stop.

14. The method of claim 13, comprising:
precluding said sleeve from at least one position with respect to said wall opening until at least one said travel stop is repositioned.

15. The method of claim 14, comprising:
moving said sleeve while repositioning at least one of said travel stops.

16. The method of claim 14, comprising:
rotating at least one travel stop along a thread to reposition it.

17. A completion method, comprising:
providing at least one wall opening in a tubular string, a multi-position valve associated with said at least one opening, and at least one external barrier on said string;
positioning said string in a wellbore;

isolating a portion of the wellbore with said barrier;

fracturing said isolated portion of the wellbore through said at least one opening when said opening is substantially unobstructed;

positioning said valve to allow flow through a filter and said at least one wall opening after said fracturing;

providing said multi-position valve in the form of a movable sleeve;

defining a fully open position said wall opening in said tubular string with or without said sleeve overlapping said wall opening;

positioning an opening on said sleeve with a filter media therein in the path of said wall opening;

connecting said sleeve to a piston in a cavity defined in part by said tubular string;

defining multiple positions of said sleeve by discrete pressure levels applied to said piston in said cavity.

18. The method of claim 17 comprising:

defining opposed variable volume cavities on opposed sides of said piston; and selectively applying pressure to one of said cavities depending on the desired direction of piston movement.

19. The method of claim 18, comprising:

using a series of projection and depression relationships between said sleeve and said tubular string to define said pressure levels for movement of said sleeve.

20. The method of claim 19, comprising:

running in a work string with at least one exterior seal;

positioning said seal so that pressure delivered through said work string communicates with one of said variable volume cavities; and displacing fluid from the other of said variable volume cavities into an annular space between said work string and said tubular string that is defined by said exterior seal.

21. A completion method, comprising:

providing at least one wall opening in a tubular string, a multi-position valve associated with said at least one opening, and at least one external barrier on said string;

positioning said string in a wellbore;

isolating a portion of the wellbore with said barrier;

fracturing said isolated portion of the wellbore through said at least one opening when said opening is substantially unobstructed;

positioning said valve to allow flow through a filter and said at least one wall opening after said fracturing;

providing said multi-position valve in the form of a movable sleeve;

defining a fully open position said wall opening in said tubular string with or without said sleeve overlapping said wall opening;

positioning an opening on said sleeve with a filter media therein in the path of said wall opening;

providing said sleeve in at least two parts;

moving one part of said sleeve with respect to another to put said wall opening in at least one of three positions comprising open without obstruction, closed and open for flow through said filter media.

* * * * *